United States Patent [19]

Ziebert

[11] 4,369,762

[45] Jan. 25, 1983

[54] SOLID FUEL SUPPORTING GRATE FOR FIREPLACE

[76] Inventor: Tony Ziebert, 1513 W. Washington St., Stayton, Oreg. 97383

[21] Appl. No.: 245,211

[22] Filed: Mar. 18, 1981

[51] Int. Cl.[3] ..... F23H 13/00

[52] U.S. Cl. ..... 126/164; 126/152 B; D23/138.5

[58] Field of Search ..... 126/164, 165, 152 R, 126/152 A, 152 B, 298, 336; D7/207, 208, 206; 211/60 R

[56] References Cited

U.S. PATENT DOCUMENTS

| | | | |
|---|---|---|---|
| D. 196,997 | 11/1963 | Falkenberg | D7/207 |
| 2,985,165 | 5/1961 | Peterson et al. | 126/165 |
| 4,140,102 | 2/1979 | Malecki | 126/164 |
| 4,215,671 | 8/1980 | Nadolsky | 126/164 |

*Primary Examiner*—James C. Yeung

*Attorney, Agent, or Firm*—Harvey B. Jacobson

[57] ABSTRACT

A plurality of pairs of crossed front-to-rear reversed and oppositely inclined elongated support members are provided and each support member includes generally parallel opposite end portions interconnected by an angulated mid-portion. The support members of each pair of support members are arranged with their mid-portions generally horizontally disposed and secured together in side-by-side horizontally laterally aligned relation and the pairs of support members are laterally aligned and horizontally spaced apart. Elongated horizontal connecting members extend between and connect similarly inclined upper end portions of the support members and the horizontal mid-portions of the support members. Further, a plurality of removable inserts each comprising an elongated member are provided and each elongated member includes a hook on one end releasably engageable with a connecting member extending between similarly inclined upper end portions of the support members and an angulated terminal end on the other end downwardly laterally abuttingly engageable with the connecting member extending between the mid-portions of the support members, the inserts being positioned centrally intermediate adjacent similarly inclined upper end portions of the support members.

10 Claims, 4 Drawing Figures

SOLID FUEL SUPPORTING GRATE FOR FIREPLACE

BACKGROUND OF THE INVENTION

Various forms of prefabricated fireplace grates and unitary fireplace grates including some of the general structural and operational features of the instant invention heretofore have been provided such as those disclosed in U.S. Pat. Nos. 2,985,165, 3,771,511, 3,987,779, 4,161,168 and 4,215,671. However, these previously known forms of grate structures include features thereof which do not offer the improved performance of the grate of the instant invention and those previously known forms of grates which are prefabricated and may thus be marketed in collapsed or knocked-down form for assembly by the ultimate purchaser generally do not include operational characteristics which are favorable to the support of various forms of solid fuels in a fireplace.

Accordingly, a need exits for an improved form of knock-down fireplace grate.

BRIEF DESCRIPTION OF THE INVENTION

The fireplace of the grate of the instant invention is constructed in a manner whereby it may be formed from a plurality of each of two individual components with 6, 8 or 10 of one component and 3 of the other components being used to form a functional fireplace grate. In this manner, and particularly in view of the fact that each of the two components used may be readily fabricated at a low cost, an extremely low cost fireplace grate may be provided. In addition, the fireplace grate is constructed in a manner whereby the width thereof may be readily increased or decreased at the time of manufacture merely by providing longer or shorter components of one type and additional or fewer pairs of components of the other type.

The main object of this invention is to provide an efficient fireplace grate.

Still another object of this invention is to provide a fireplace grate which may be marketed in a compact knock-down form and readily assembled by the ultimate purchaser of the grate.

Still another very important object of this invention is that it is also suitable to be used in a Heating Stove in same manner as in a fireplace.

Still another very important object of this invention is to provide a fireplace grate which may be readily manufactured in difference sizes.

A further object of this invention is to provide a fireplace grate which may be adapted for use in conjunction with various different forms of solid fireplace fuels.

Another object of this invention is to provide a fireplace grate constructed in a manner whereby individual components thereof may be readily replaced in the event of damage thereto.

The final object of this invention to be specifically enumerated herein is to provide a fireplace grate in accordance with the preceding objects and which will conform to conventional forms of manufacture, be of simple construction and easy to use so as to provide a device that is economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Referring now more specifically to the drawings, the numeral 10 generally designates the fireplace of the instant invention. The grate 10 includes a plurality of pairs of oppositely inclined front-to-rear reversed support members 12 and a plurality of elongated interconnecting members 14.

Figure 2:
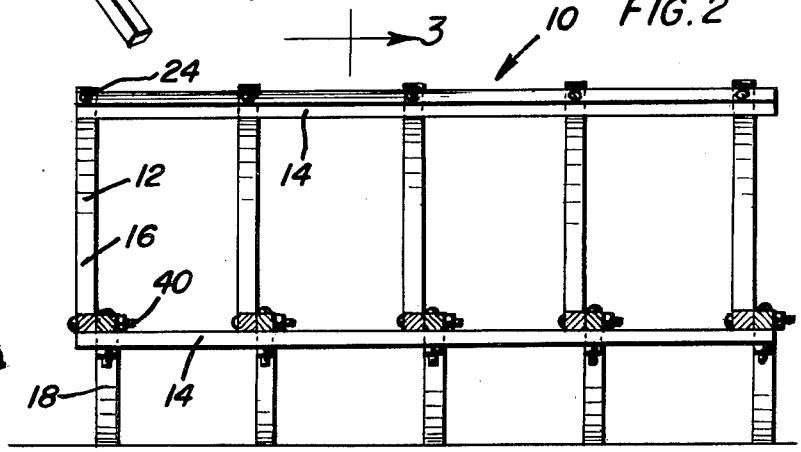
FIG. 2 is a vertical sectional view taken substantially upon the plane indicated by the section line 2—2 of FIG. 1.

Each of the support members 12 includes a pair of generally parallel opposite end portions 16 and 18 and an angulated mid-point 20. The support members 12 of each pair of support members are reversed in front-to-rear relation and are oppositely inclined as may best seen from FIGS. 2 and 3 of the drawings. The end portions 16 are somewhat longer than the end portions 18 and the end portions 16 comprise solid fuel support arms for the fuel to be burned in an associated fireplace while the end portions 18 comprise the legs of the grate 10.

The upper ends of similarly inclined upper end portions 16 of the pairs of support members 12 are interconnected through the utilization of one of the elongated connecting members 14 overlapping the upper sides of the corresponding upper end portions 16 and secured thereto through the utilization of suitable fasteners 24. In addition, the horizontal mid-portions of each pair of oppositely inclined support members 12 are interconnected through the utilization of a third elongated connecting member 14 underlying and secured to at least one mid-portion 20 of each pair of support members 12 through the utilization of a fastener 28.

Figure 1:
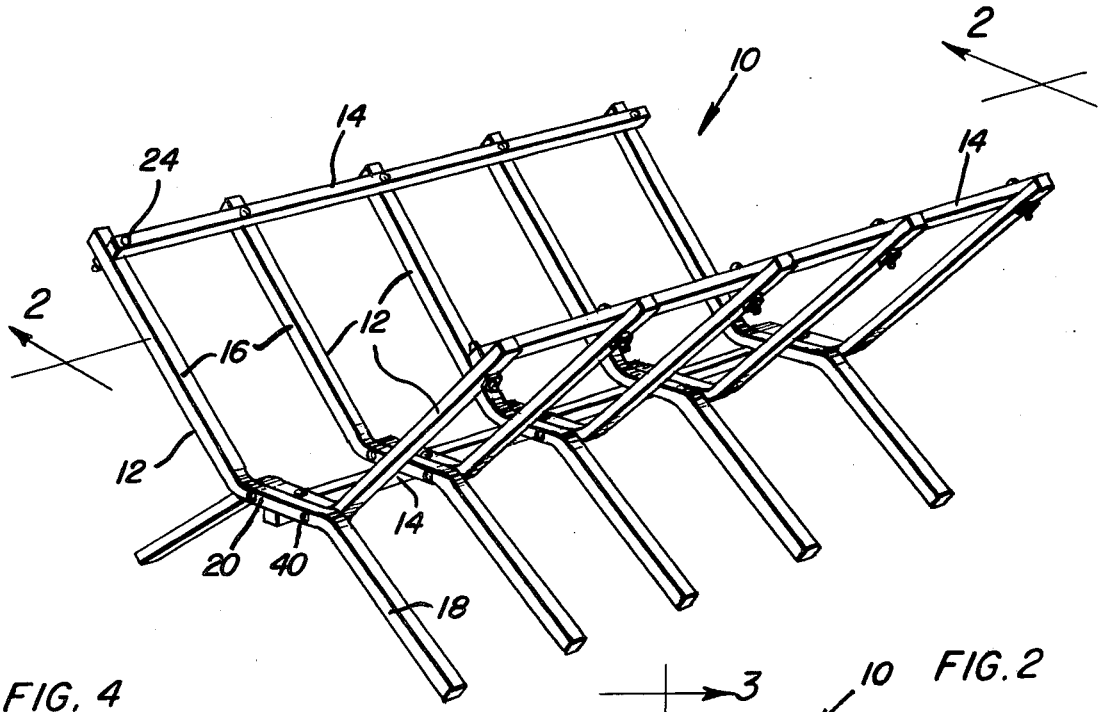
FIG. 1 is a perspective view of a fireplace grate constructed in the form of the present invention.

From FIG. 1 of the drawings it may be readily seen that the length of the grate 10 as measured transversely of the vertical plane in which the pairs of support members 12 are contained may be reduced by providing shorter connecting members 14 and by reducing the number of pairs of support members 12. Likewise, the length of the grate 10 may be increased by providing longer connecting members 16 and utilizing additional pairs of support members 12.

Figure 3:
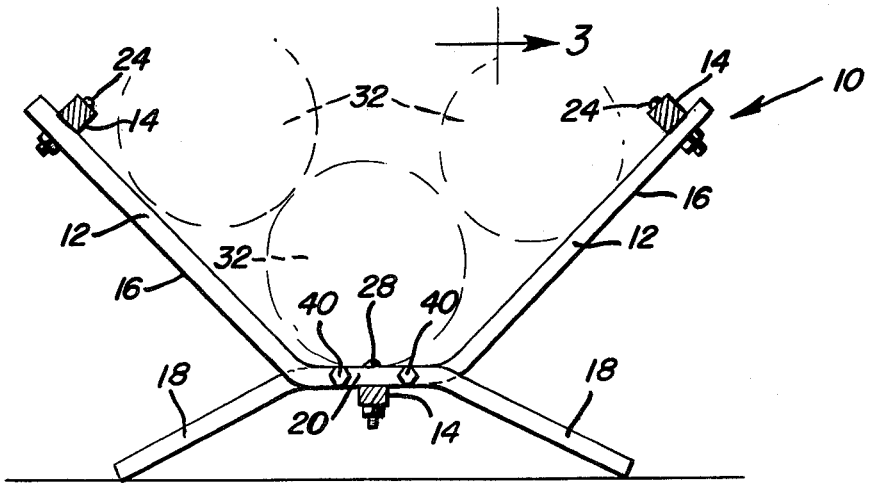
FIG. 3 is a vertical sectional view taken substantially upon the plane indicated by the section line 3—3 of FIG. 2.

As may be seen by the phantom lines in FIG. 3 of the drawings, a plurality of logs 32 may be stacked within the grate 10 in an unusual fashion with a single log lowermost, a pair of front and rear intermediate height logs and a forth log uppermost cradled between the front and the rear logs.

Figure 4:
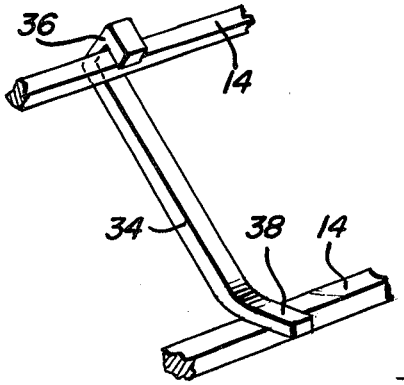
FIG. 4 is a fragmentary perspective view illustrating the manner in which one form of adapter may be utilized in conjunction with the fireplace grate in order to adapt the same for use with a different solid fireplace fuel.

If the grate 10 is to be used in conjunction with solid fuel other than logs 32 and of smaller size than the logs 32, a plurality of inserts 34 may be provided to reduce the effective space in between the upper end portions 16 of the support members 12. A single insert 34 is illustrated in FIG. 4 of the drawings and incliudes an upper hooked end 36 for releasable engagement with the corresponding upper connecting member 14 and angulated lower end 38 for downwardly laterally abutting the lower central connecting member 14. In this manner, the space in between adjacent upper end portions 16 of the support members 12 may be effectively reduced in order to enable the grate 10 to handle other types of fireplace solid fuel such as coal or wood scraps.

It will of course be appreciated that the mid-portions of each pair of support members 12 are interconnected through the utilization of suitable fasteners 40 and that the fasteners 24, 28 and 40 are all removable. Therefore, the grate 10 may be marketed in a compact disassembled state and readily assembled by the ultimate purchaser and user of the grate 10 through the utilization of simple hand tools. Further, the length of the grate 10 may be readily varied as herein above set forth and the insert 34 may be marketed as an accessory for the grate 10.

It is to be understood that the various members 12, 14 and 34 will be constructed of solid metal stock of generally square cross sectional shape. Further, such stock is normally straight and thus the connecting members 14 may be readily produced merely by cutting the correct length of stock in order to provide the connecting members 14. In addition, inasmuch as the support members 12 each merely have a pair of opposite bends formed therein, the support members 12 may be readily formed.

Further, as may be seen from FIG. 3, the upper end portions 16 are inclined substantially 45° relative to the horizontal. In this manner coals or embers dropping from a fire in the grate 10 will drop into an area bound by the lower portions 18 substantially beneath the center of the fire and the user of the grate 10 may therefore regulate the amount of heat given off by the coals or embers by distributing or covering up the same.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A fireplace grate for solid fuel, such grate including a plurality of pairs of crossed and front-to-rear reversed elongated support members each including generally parallel opposite end portions interconnected by an angulated mid-portion, said support members of each pair of support members being oppositely inclined with their mid-portions generally horizontally disposed and secured together in side-by-side horizontally aligned relation, said pairs of support members being laterally aligned in horizontally spaced relation, and elongated horizontal connecting members extending between and connecting corresponding portions of said pairs of support members.

2. The combination of claim 1 wherein one pair of corresponding end portions of the support members of each of support members are longer than the other pair of corresponding end portions thereof.

3. The combination of claim 2 wherein the longer end portions of said support members comprise the upper end portions of said inclined support members.

4. The combination of claim 1 wherein said elongated connecting members equal at least three in number and extend between and interconnect the upper end portions of said support members and the horizontal mid-portions of said support members.

5. The combination of claim 4 wherein said three elongated connecting members overlap and are secured to the upper side of said upper end portions and underly and are secured to the underside of said mid-portions.

6. The combination of claim 1 wherein said support members are constructed of solid metal stock of substantially rectangular cross sectional shape.

7. A fireplace grate for solid fuel, such grate including a plurality of pairs of crossed and front-to-rear reversed elongated support members each including generally parallel end portions interconnected by an angulated mid-portion, said support members of each pair of support members being oppositely inclined with their mid-portions generally horizontally disposed and secured together in side-by-side horizontally aligned relation, said pairs of support members being laterally aligned in horizontally spaced relation, and elongated horizontal connecting members extending between and connecting corresponding upper end portions of said pairs of support members, a plurality of removable inserts, each of said inserts comprising an elongated member provided with a hook on one end releasably engageable with one of the connecting members extending between the upper ends of said support members and the other end of each of said inserts including an angulated end portion downwardly laterally abuttingly engaging the upper surface of the elongated connecting member extending between and connected to the mid-portions of said support members.

8. The combination of claim 7 wherein one pair of corresponding end portions of the support members of each pair of support members are longer than the other pair of corresponding end portions thereof.

9. The combination of claim 8 wherein the longer end portions of said support members comprise the upper end portions of said inclined support members.

10. The combination of claim 7 wherein the upper end portions of said support members are inclined substantially 45° relative to a horizontal plane containing said mid-portions.

* * * * *